US008319130B2

(12) United States Patent
Lee et al.

(10) Patent No.: US 8,319,130 B2
(45) Date of Patent: Nov. 27, 2012

(54) LIGHT EMITTING KEY STRUCTURE

(75) Inventors: Mang-Shiang Lee, Chung-Li (TW); Chung-Lin Tsai, Chung-Li (TW)

(73) Assignee: Global Lighting Technologies (Taiwan) Inc., Chung-Li (TW)

( * ) Notice: Subject to any disclaimer, the term of this patent is extended or adjusted under 35 U.S.C. 154(b) by 0 days.

(21) Appl. No.: 13/323,806

(22) Filed: Dec. 12, 2011

(65) Prior Publication Data

US 2012/0081917 A1 Apr. 5, 2012

Related U.S. Application Data

(63) Continuation of application No. 12/396,462, filed on Mar. 2, 2009, now Pat. No. 8,097,822.

(30) Foreign Application Priority Data

Mar. 5, 2008 (TW) ..... 97203697 U

(51) Int. Cl.
*H01H 9/00* (2006.01)

(52) U.S. Cl. ..... 200/314

(58) Field of Classification Search ..... 200/310–314, 200/317, 512–520, 5 A, 5 R, 341, 237, 344
See application file for complete search history.

(56) References Cited

U.S. PATENT DOCUMENTS

| | | | | |
|---|---|---|---|---|
| 6,860,612 | B2 * | 3/2005 | Chiang et al. | 362/29 |
| 7,057,125 | B1 * | 6/2006 | Tsai | 200/310 |
| 7,378,606 | B2 * | 5/2008 | Lee et al. | 200/314 |
| 7,388,167 | B2 * | 6/2008 | Liao et al. | 200/310 |
| 7,525,056 | B2 * | 4/2009 | Chiba et al. | 200/314 |
| 7,588,338 | B2 * | 9/2009 | Chou | 362/24 |
| 7,608,792 | B1 * | 10/2009 | Tsai | 200/310 |
| 7,628,500 | B2 * | 12/2009 | Chou | 362/30 |
| 7,709,760 | B2 * | 5/2010 | Chen et al. | 200/314 |
| 2007/0125634 | A1 * | 6/2007 | Jung | 200/310 |
| 2009/0173607 | A1 * | 7/2009 | Lee et al. | 200/310 |
| 2010/0147661 | A1 * | 6/2010 | Takeda | 200/314 |
| 2010/0300854 | A1 * | 12/2010 | Chen et al. | 200/310 |

* cited by examiner

*Primary Examiner* — Edwin A. Leon
(74) *Attorney, Agent, or Firm* — Lin & Associates IP, Inc.

(57) ABSTRACT

A light emitting key structure is provided. The key structure includes a base, a reflective sheet, a circuit board, an elastic member, a linkage mechanism, and a key cap sequentially disposed one on another in order. The reflective sheet is disposed on the base. The circuit board is made of a light guide material. At least one light source is bonded to a lateral side of the circuit board. The circuit board, together with the light source bonded to the lateral side thereof is disposed on the reflective sheet. The elastic member is directly coupled to the circuit board. The key cap is featured with a light transmission characteristic. Therefore, in operation, the light emitted from the light source can be directly guided into the circuit board, and then outputted from the light transmissive key cap, thus achieving the light emitting effect.

10 Claims, 4 Drawing Sheets

LIGHT EMITTING KEY STRUCTURE

CROSS REFERENCE

This is a continuation application of U.S. patent application Ser. No. 12/396,462, filed on Mar. 2, 2009, now U.S. Pat. No. 8,097,822, issued Jan. 17, 2012, which is incorporated herewith by reference.

BACKGROUND OF THE INVENTION

1. Field of the Invention

The present invention relates generally to a light emitting key structure for a keyboard.

2. The Prior Arts

Early laptop computers and desktop computers are usually equipped with keyboards which are incapable of emitting light. Recently, with the progress of the backlight module technology, light emitting apparatuses have been provided to conventional keyboards by some of the keyboard manufacturers, for providing illumination to the keyboards or for ornament purpose.

Taiwanese patent publication No. 509955 proposes a light emitting keyboard. The light emitting keyboard is featured in that it includes a key portion and a backlight device. The key portion includes a bottom plate and at least one key disposed on the bottom plate. The key is adapted for upwardly and downwardly moving relative to the bottom plate. The backlight device is disposed beneath the key portion for providing a light source for the key portion from the underside of the key portion. The light source provides a light upwardly passing through the key portion so as to provide a light emitting effect to the keyboard. In addition to an object of providing the light emitting effect to the keyboard, Taiwanese patent publication No. 509955 further provides a light emitting keyboard with a smaller thickness. However, in electronic products requiring a higher degree of portability and slimness, the keyboard proposed by Taiwanese patent publication No. 509955 is not good enough.

SUMMARY OF THE INVENTION

A primary objective of the present invention is to provide an improvement to the key structure proposed by Taiwanese patent publication No. 509955, for achieving a smaller thickness of the key, thus satisfying the requirement for a higher degree portability and slimness of the electronic products.

According to an embodiment of the present invention and comparing with the conventional technology, the present invention is featured in that it eliminates a light guide plate which is usually contained in the backlight module of the light emitting key according to the conventional technology. As such, the thickness of the eliminated light guide plate can be reduced. In order to achieve equivalent function while eliminating the light guide plate, the present invention employs a light guide material for fabricating a circuit board required for the key structure. A light source is directly bonded to a lateral side of the circuit board. Therefore, in operation, the light emitted from the light source can be directly guided into the circuit board, and then outputted from the light transmissive keys, thus achieving the light emitting effect.

According to another embodiment of the present invention and comparing with the conventional technology, the present invention is featured in that it eliminates a light guide plate which is usually contained in the backlight module of the light emitting key according to the conventional technology. As such, the thickness of the eliminated light guide plate can be reduced. In order to achieve equivalent function while eliminating the light guide plate, the present invention employs a light guide material for fabricating a thin film overlapped on a circuit board required for the key structure. A light source is directly provided at a lateral side of the thin film. Therefore, in operation, the light emitted from the light source can be directly guided into the thin film, and then outputted from the light transmissive keys, thus achieving the light emitting effect.

The present invention provides a key structure. According to an embodiment of the present invention, the key structure includes a base, a reflective sheet, a circuit board, an elastic member, a linkage mechanism, and a key cap sequentially disposed one on another in order. The reflective sheet is disposed on the base. The circuit board is made of a light guide material. At least one light source is bonded to a lateral side of the circuit board. The circuit board, together with the light source bonded to the lateral side thereof is disposed on the reflective sheet. The elastic member is directly coupled to the circuit board. A bottom end of the linkage mechanism is arranged through the circuit board and connected to the base. A top end of the linkage mechanism is connected to the key cap. The key cap is a light transmissive key. Therefore, in operation, the light emitted from the light source can be directly guided into the circuit board, and then outputted from the light transmissive key cap, thus achieving the light emitting effect. According to the key structure of the present invention, the overall thickness of the key structure can be reduced.

According to another embodiment of the present invention, the key structure includes a base, a circuit board, a reflective sheet, a thin film, an elastic member, a linkage mechanism, and a key cap sequentially disposed one on another in order. The circuit board is disposed on the base. The circuit board is covered with the thin film which is made of a light guide material. At least one light source is provided at a lateral side of the thin film. The reflective sheet is disposed between the thin film and the circuit board. The elastic member is directly connected to the thin film. A bottom end of the linkage mechanism is arranged through the thin film and the circuit board and connected to the base. A top end of the linkage mechanism is connected to the key cap. The key cap is a light transmissive key. Therefore, in operation, the light emitted from the light source can be directly guided into the thin film, and then outputted from the light transmissive key cap, thus achieving the light emitting effect. According to the key structure of the present invention, the overall thickness of the key structure can also be reduced.

Alternatively, the reflective sheet can also be omitted from the embodiment of the present invention. When the reflective sheet is not used, the light emitted from the light source is directly guided into the circuit board or the thin film, both of which are light transmissive, and then the light is outputted from the key cap, thus achieving the light emitting effect.

When considering to achieve a more uniform and soft light outputted from the key cap, the present invention can also provide an optical light guide structure under the circuit board or the thin film. In such a way, when the light is reflected by the reflective sheet, the light can also be uniformed and softened by the optical light guide structure. The optical light guide structure includes a plurality of fine round convex dots, round concave dots, polygon convex dots, or polygon concave dots.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
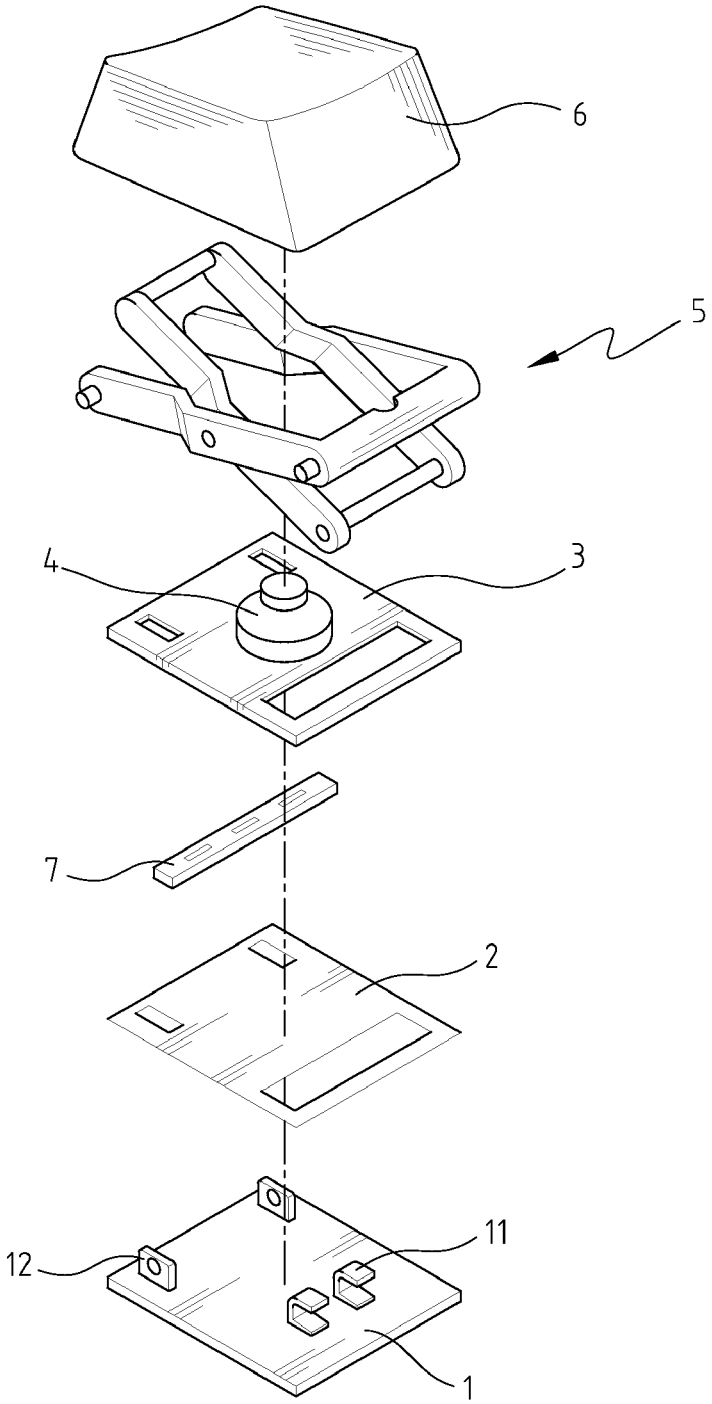
FIG. 1 is a perspective exploded view of a light emitting key structure for illustrating the assembly relationship of essential parts thereof according to a first embodiment of the present invention.
Figure 2:
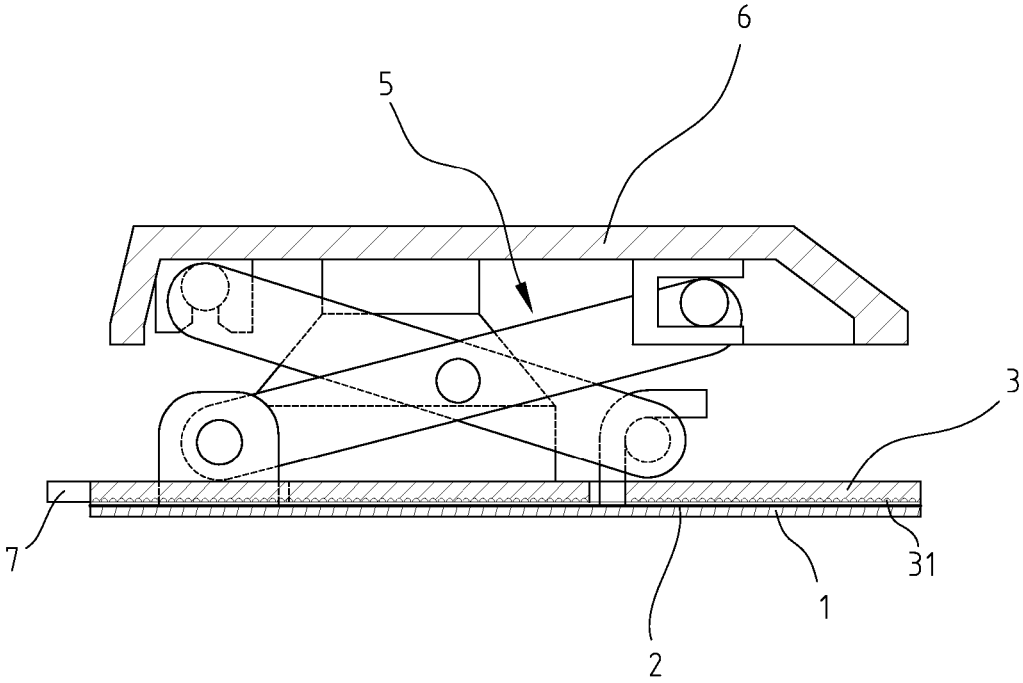
FIG. 2 is a cross-sectional view of the light emitting key structure of FIG. 1.

FIG. 1 is a perspective exploded view of a light emitting key structure for illustrating the assembly relationship of essential parts thereof according to a first embodiment of the present invention. FIG. 2 is a cross-sectional view of the light emitting key structure of FIG. 1. Referring to FIGS. 1 and 2, the light emitting key structure includes a base 1, a reflective sheet 2, a circuit board 3, an elastic member 4, a linkage mechanism 5, and a key cap 6. The base 1 is a supporting board of the entire key structure. The base 1 is configured with a pair of hooks 11 and a pair of protrusion ears 12. The reflective sheet 2 is a sheet member made of a light reflective material. The reflective sheet 2 is bonded to an upper surface of the base 1.

The circuit board 3 includes a circuit distributed thereon for controlling a key signal operation. Specifically, according to an aspect of the embodiment, the circuit board 3 is made of a light transmissive material, e.g., a transparent plastic or rubber material. The elastic member 4 is provided on the circuit board 3. The elastic member 4 includes an electric conduction portion (not shown in the drawings) configured at a bottom of the elastic member 4. When the elastic member 4 is downwardly pressed, the electric conduction portion is driven to get in contact with an electric contact of the circuit board 3, so as to trigger the circuit to generate a signal. Further, a light source 7 is provided at a lateral side of the circuit board 3 for projecting a light into the circuit board 3 from the lateral side. Preferably, the light source 7 is disposed at the lateral side of the circuit board 3 in contact with the circuit board 3 as shown in FIG. 2 and the light is projected into the circuit board 3 along a direction perpendicular with the lateral side.

The linkage mechanism 5 is configured by a pair of pivotally cross-connected rod members. The linkage mechanism 5 has two bottom ends and two top ends. The two bottom ends are arranged sequentially through the circuit board 3 and the reflective sheet 2, and assembled to the hooks 11 and pivotally coupled to the protrusion ears 12, respectively. The top ends of the linkage mechanism 5 are assembled to the key cap 6. The key cap 6 is made of a light transmissive material, e.g., acrylics, plastic, rubber, or the like. Therefore, when the light source emits a light, the light is allowed to be directly transmitted through the circuit board 3, and a part of the light is reflected by the reflective sheet 2. The light together with the reflected part is then outputted through the key cap 6. In such a way, the key structure achieves the desired light emitting effect. Alternatively, the reflective sheet 2 can also be adaptively omitted. In this case, the light is directly outputted from the circuit board 3 through the key cap 6. Further, according to an aspect of the embodiment, as shown in FIG. 2, the light emitting key structure further includes an optical light guide structure 31 disposed at a bottom surface of the circuit board 3. The optical light guide structure 31 for example can be a plurality of fine round convex dots, round concave dots, polygon convex dots, or polygon concave dots. When the light is transmitted into the circuit board 3, the light is reflected by the optical light guide structure 31, during which the light is also dispersed by the optical light guide structure 31. In such a way, a uniformed and softened light can be obtained and thus outputted through the key cap 6.

Figure 3:
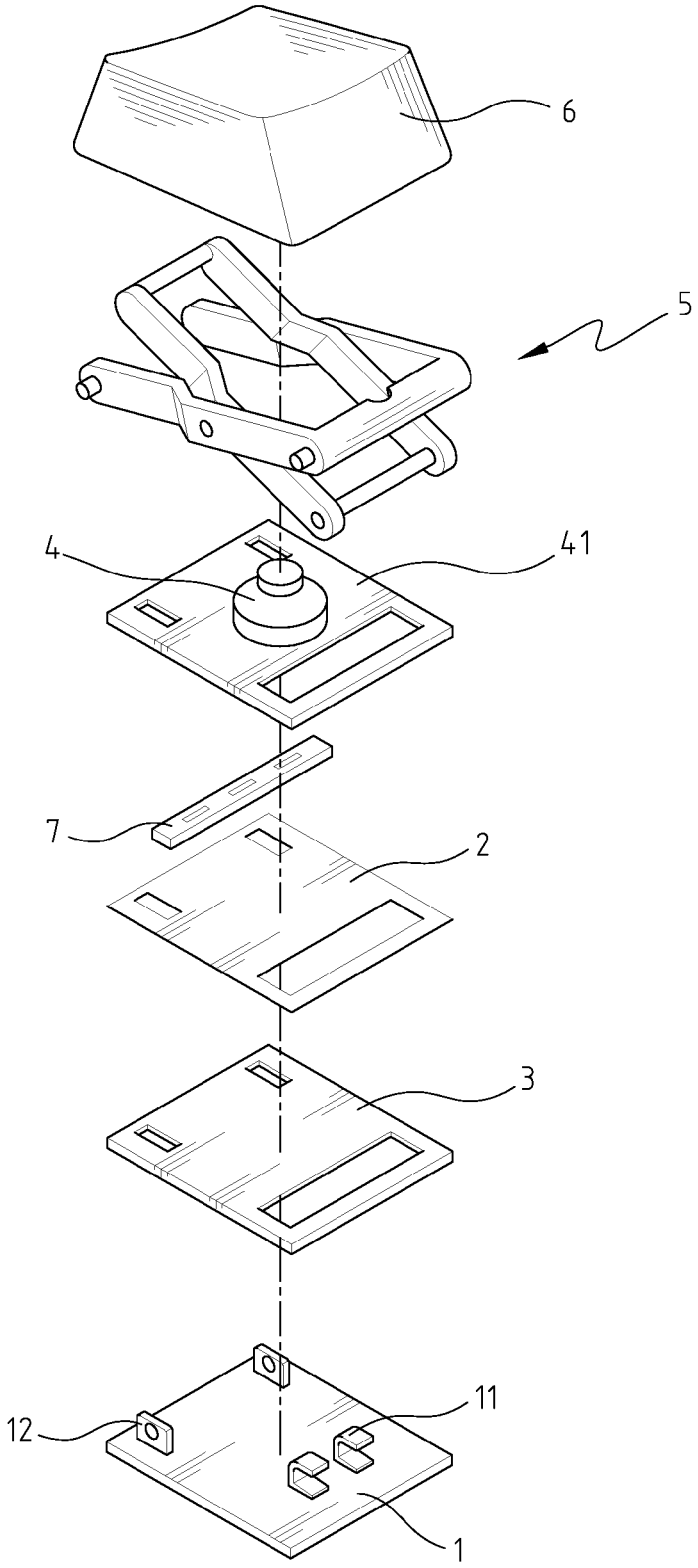
FIG. 3 is a perspective exploded view of a light emitting key structure for illustrating the assembly relationship of essential parts thereof according to a second embodiment of the present invention.
Figure 4:
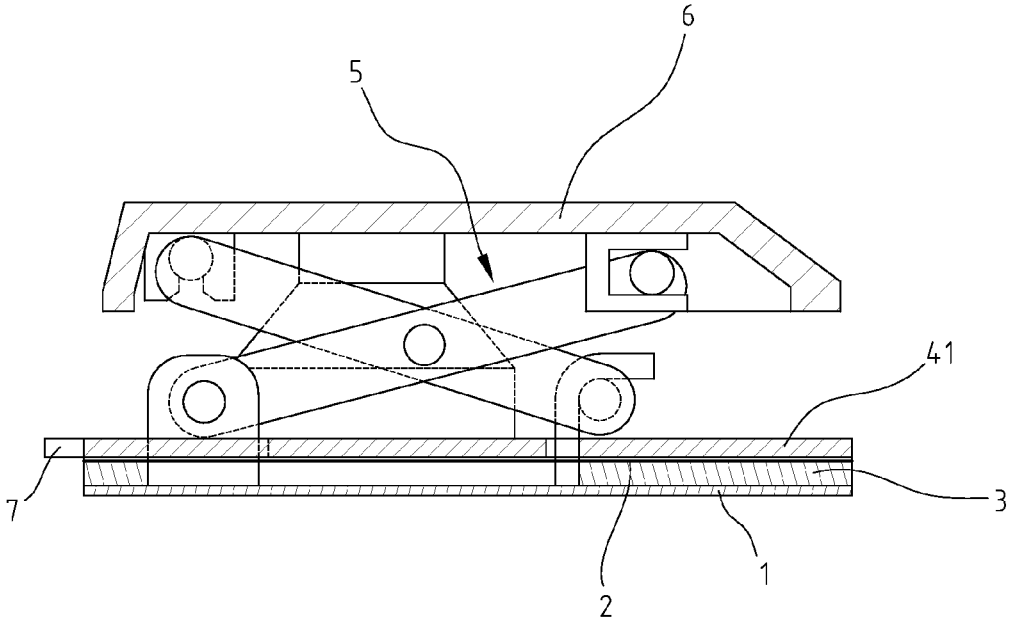
FIG. 4 is a cross-sectional view of the light emitting key structure of FIG. 3.

FIG. 3 is a perspective exploded view of a light emitting key structure for illustrating the assembly relationship of essential parts thereof according to a second embodiment of the present invention. FIG. 4 is a cross-sectional view of the light emitting key structure of FIG. 3. Referring to FIGS. 3 and 4, the light emitting key structure includes a base 1, a circuit board 3, a reflective sheet 2, a thin film 41, a linkage mechanism 5, and a key cap 6. The thin film 41 includes an elastic member 4 bonded thereto. The base 1 is a supporting board of the entire key structure. The base 1 is configured with a pair of hooks 11 and a pair of protrusion ears 12.

The circuit board 3 includes a circuit distributed thereon for controlling a key signal operation. Specifically, according to this embodiment, the circuit board 3 can be made of either a transparent material or a non-transparent material. The thin film 41 overlaps the circuit board 3, for providing a protection to the circuit elements of the circuit board 3. The elastic member 4 includes an electric conduction portion (not shown in the drawings) configured at a bottom of the elastic member 4. The electric conduction portion is exposed from an underside of the thin film 41. With the thin film 41 bonded to the circuit board 3, when the elastic member 4 is downwardly pressed, the electric conduction portion is driven to get in contact with an electric contact of the circuit board 3, so as to trigger the circuit to generate a signal. Further, a light source 7 is provided at a lateral side of the thin film 41 for projecting a light into the thin film 41 from the lateral side. Preferably, the light is projected into the thin film 41 along a direction perpendicular with the lateral side of the thin film 41. The linkage mechanism 5 and the key cap 6 are similar to those discussed in the first embodiment and can be learnt by referring thereto, and are not to be iterated hereby. In such a way, when the light source 7 emits a light, the light is allowed to be directly transmitted through the circuit board 3, and a part of the light is reflected by the reflective sheet 2. The light together with the reflected part is then outputted through the key cap 6. In such a way, the key structure achieves the desired light emitting effect. Alternatively, the reflective sheet 2 can also be adaptively omitted. In this case, the light is directly outputted from the thin film 41 through the key cap 6. Further, according to an aspect of the embodiment, the light emitting key structure further includes an optical light guide structure similar to the optical light guide structure 31 (referring to FIG. 2) disposed at a bottom surface of the thin film 41. When the light is transmitted into the thin film 41, the light is reflected by the optical light guide structure, during which the light is also dispersed by the optical light guide structure. In such a way, uniformed and softened light can be obtained and thus outputted through the key cap 6.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A backlight module for a keyboard, comprising:

a base;

a circuit board disposed over the base and made of a light-guiding material; and a light source, disposed at a lateral side of the circuit board in contact with the lateral side, and projecting a light along a direction perpendicular to the lateral side into the circuit board laterally from the lateral side of the circuit board.

2. The backlight module as claimed in claim 1, further comprising a reflective sheet disposed between the base and the circuit board.

3. The backlight module as claimed in claim 1, further comprising an optical light guide structure provided at a surface of the circuit board, wherein the circuit board has the surface facing the base.

4. The backlight module as claimed in claim 3, wherein the optical light guide structure comprises a plurality of fine convex dots.

5. The backlight module as claimed in claim 3, wherein the optical light guide structure comprises a plurality of fine concave dots.

6. A backlight module for an electronic apparatus, comprising:

a base;

a circuit board disposed over the base and made of a light-guiding material; and a light source, disposed at a lateral side of the circuit board in contact with the lateral side, and projecting a light along a direction perpendicular to the lateral side into the circuit board laterally from the lateral side of the circuit board.

7. The backlight module as claimed in claim 6, further comprising a reflective sheet disposed between the base and the circuit board.

8. The backlight module as claimed in claim 6, further comprising an optical light guide structure provided at a surface of the circuit board, wherein the circuit board has the surface facing the base.

9. The backlight module as claimed in claim 8, wherein the optical light guide structure comprises a plurality of fine convex dots.

10. The backlight module as claimed in claim 8, wherein the optical light guide structure comprises a plurality of fine concave dots.

* * * * *